United States Patent [19]

Hillstrom

[11] Patent Number: 4,862,615

[45] Date of Patent: Sep. 5, 1989

[54] RELEASABLE ANCHORING AND TENSIONING APPARATUS FOR BILLBOARD DISPLAYS

[75] Inventor: David U. Hillstrom, Novi, Mich.

[73] Assignee: Marketing Displays, Inc., Farmington Hills, Mich.

[21] Appl. No.: 187,587

[22] Filed: Apr. 28, 1988

[51] Int. Cl.[4] ..... G09F 17/00; G05G 1/00

[52] U.S. Cl. ..... 40/603; 74/575; 160/328

[58] Field of Search ..... 40/624, 603; 38/102.1, 38/102.91; 74/527, 575, 578; 160/328, 329, 373, 374.1, 378; 242/67.1, 67.3 F

[56] References Cited

U.S. PATENT DOCUMENTS

| | | | |
|---|---|---|---|
| 417,767 | 12/1889 | Barnes | 38/102.1 |
| 1,194,610 | 8/1916 | Fischer | 40/603 |
| 1,253,720 | 1/1918 | Pierson | 38/102.1 |
| 1,297,820 | 3/1919 | Fitzgerald | 40/603 |
| 1,738,793 | 12/1929 | Paine | 40/603 |
| 1,867,598 | 7/1932 | Schorr et al. | 40/624 |
| 2,962,261 | 11/1960 | Lucker | 74/575 |
| 3,934,365 | 1/1976 | Stein et al. | 40/603 |
| 3,982,345 | 9/1976 | Coleman | 160/378 |
| 4,372,071 | 2/1983 | Vicino | 40/603 |
| 4,409,749 | 10/1983 | Hamu | 160/378 |
| 4,441,269 | 4/1984 | Dahl | 40/603 |
| 4,674,213 | 6/1987 | Keithley | 40/603 |
| 4,739,568 | 4/1988 | Gearhart | 40/603 |

OTHER PUBLICATIONS

Photographs (3) of ratchet/strap tensioning device.

*Primary Examiner*—Richard J. Apley
*Assistant Examiner*—J. Welsh
*Attorney, Agent, or Firm*—Harness, Dickey & Pierce

[57] ABSTRACT

An anchoring apparatus for anchoring and tensioning a sheet material on a panel structure, such as a billboard. A preferred channel-shaped base member is secured to the rear of the panel structure and includes a ratcheted clip member slidably connected to the base member. The clip member is conveniently ratcheted to tension the sheet material, or disengaged to release or relax the sheet material, using a screwdriver or other common lever-type tool, thus greatly facilitating the ease and speed of erection, anchoring, tensioning and removal of the sheet material.

12 Claims, 3 Drawing Sheets

RELEASABLE ANCHORING AND TENSIONING APPARATUS FOR BILLBOARD DISPLAYS

BACKGROUND AND SUMMARY OF THE INVENTION

The invention relates generally to an apparatus for anchoring and selectively tensioning or relaxing a sheet material on a panel structure, and more particularly for such apparatuses used for anchoring and selectively tensioning and relaxing or releasing a sheet material display on a billboard structure.

Large billboards displaying advertising or public service messages are a common sight along roadways and other areas for communicating messages to the public. One common type of billboard has a front display face that is fourteen feet high and forty-eight feet wide. Although other sizes of billboards are also used, this fourteen foot by forty-eight foot size is especially advantageous for high visibility along roadways and from relatively great distances.

Although effective for communicating advertising or public service messages, the process of positioning a display message on such billboards, and replacing one display message with another, has been found to be expensive, time-consuming, and cumbersome. In the past, such display messages were painted or printed on a paper-like sheet of material, which was then cut into strips or sections that could be pasted or otherwise adhered to the front face of the billboard. More recently, large relatively flexible sheets of synthetic materials were developed, typically composed of a reinforced nylon material, onto which the display message was painted or otherwise printed, typically with the use of computer-aided processes. These large sheet material displays, commonly referred to as "superflex" material, are then rolled onto a large roll, which was then lifted into position using a crane or other suitable lifting apparatuses. The sheet material display is then unrolled onto the front face of the billboard, with the vertical and horizontal edge portions of the sheet material display extending around the edges of the billboard. The edges are then typically anchored and tensioned by way of a number of separate of flexible strip-and-hook mechanisms, which include a wheel-type ratchet mechanism for tightening the strap and thereby tensioning the sheet material display.

The above-described method for anchoring and tensioning the sheet material display on the billboard, using the strap and ratchet wheel mechanisms described above, has been found to present a number of significant disadvantages. First, the personnel involved in anchoring and tensioning the display sheet are required to carry a large number of the strap and ratchet wheel mechanisms when climbing onto the rear face of the billboard, frequently at great heights. Secondly, because of variations in the supporting structure for the billboard, there is frequently no conveniently-located portion of the support structure to which the straps can be anchored. Accordingly, in the case of the large billboards mentioned above, the erection, anchoring, and tensioning of sheet material billboard display frequently takes several hours to accomplish and presents great danger and difficulty to persons performing the task. Also, because one end of the strap and ratchet wheel mechanisms includes a hook that must be inserted through an opening in a bar that is in turn hemmed into the edges of the sheet material, anchoring difficulties are frequently encountered if the holes in the anchoring bar are not located near a support member of the billboard supporting structure. As a result, in such an instance, the opposite end of the strap and ratchet wheel mechanisms must be secured to the supporting structure by way of ropes, cables, wire, additional straps, or the like, which is cumbersome, time-consuming and frequently unsuitable.

Accordingly, the need has arisen for a simpler, more uniform, and more convenient apparatus for anchoring, tensioning, and subsequently releasing a sheet material display on a billboard structure. The present invention seeks to meet this need by providing an apparatus that is associated and attached to the billboard and that allows for easily and conveniently tensioning and subsequently relaxing a sheet material display on a billboard structure.

The apparatus according to the present invention includes an elongated base member having a generally U-shaped lateral cross-section, with the base member including a base plate portion and a pair of laterally spaced-apart leg portions protruding from the base plate portion. Each of the leg portions preferably includes a slot formed therein, with the slots on the leg portions facing and opening generally toward one another. The preferred base portion further includes a number of ratchet teeth serially spaced longitudinally therealong, and openings formed therein for receiving fasteners in order to fixedly secure the elongated base member to the panel or billboard structure, or alternatively including other known devices for fixedly securing the base member to the panel structure.

The anchoring apparatus of the invention also includes a clip member having a clip plate portion received within the above-mentioned slots for selective slidable longitudinal movement along the base member, an attachment portion for releasably engaging a portion of the sheet material or an anchoring bar hemmed into the sheet material, and a pawl portion protruding from the clip plate portion and resiliently biased into releasable ratcheting engagement with the ratchet teeth on the base member. Such engagement with any one of the ratchet teeth substantially prevent longitudinal movement of the clip member relative to the base member in a first longitudinal direction (toward the edge of the billboard) when the pawl portion engages one of the ratchet teeth, thus anchoring the sheet material display in a desired, tensioned state. The clip member is selectively movable in a second, opposite longitudinal direction (away from the edge of the billboard) relative to the base member in order to serially advance the pawl portion from engagement with one of the ratchet teeth to engagement with an adjacent ratchet tooth, thereby increasing the tensioning of the sheet material. The pawl portion is also selectively releasable in order to disengage from the ratchet teeth in order to then allow movement of the clip member relative to the base member toward the edge of the billboard, thereby relaxing or releasing the sheet material for removal.

Preferably, the above-mentioned tensioning of the sheet material is accomplished by inserting a screwdriver or other lever-type member through an opening formed in the clip plate portion and into engagement with the ratchet teeth in order to forcibly pry or urge the clip member with a pivoting motion of the lever so as to move the clip member relative to the base member and away from the edge of the billboard. Releasing or relaxation of the sheet material display is preferably accomplished by inserting the screwdriver or other lever member through an opening in the clip plate portion and into engagement with a discontinuity on the pawl portion of the clip member, thus allowing the resilient pawl portion to be forcibly disengaged from the ratchet teeth and allowing the clip member to be moved relative to the base member in longitudinal direction toward the edge of the billboard, thereby relaxing or releasing the tension on the sheet material display.

Furthermore, in the preferred embodiment of the present invention, the attachment portion of the clip member includes a generally hook-shaped end adapted for releasable engagement with the sheet material or with an anchoring member or bar secured to the sheet material. Preferably, the anchoring bar or member includes a groove formed therein for releasably and interlockingly receiving the hook-shaped end of the attachment portion of the clip member. The preferred attachment portion of the clip member is at least partially offset outwardly or rearwardly away from the base member in an area adjacent the hook-shaped end, thus allowing the anchoring bar or member on the sheet material to be disposed between the offset portion and the base member when the hook-shaped end is received within the groove in the anchoring bar or member. This provides clearance for tensioning or relaxing movement of the anchored edge of the sheet material relative to the base member of the apparatus, as well as allowing for convenient engagement or disengagement of the attachment portion with or from the sheet material.

Additional objects, advantages and features of the present invention will become apparent from the following description and appended claims, taken in conjunction with the accompanying drawings.

DETAILED DESCRIPTION OF THE PREFERRED EMBODIMENTS

FIGS. 1 through 6 depict one preferred, exemplary embodiment of an anchoring apparatus according to the present invention, which is particularly adapted for anchoring and tensioning a sheet material display on a large billboard structure. One skilled in the art will readily recognize from the following description that the present invention is not limited to billboard applications, but is also advantageous in other structures wherein a sheet material is to be anchored and selectively tensioned or relaxed on a panel structure.

Figure 1:
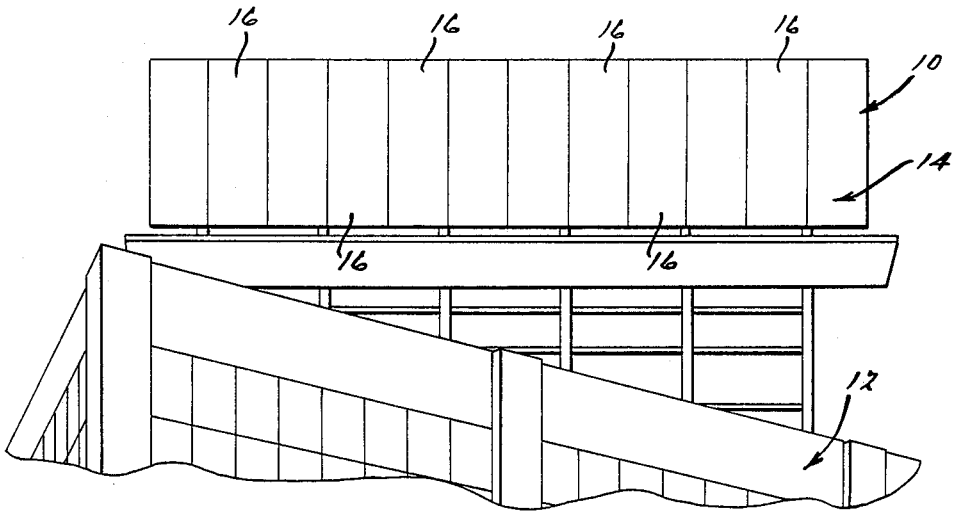
FIG. 1 illustrates a typical billboard installation, exemplifying one of the primary applications of the present invention.
Figure 2:
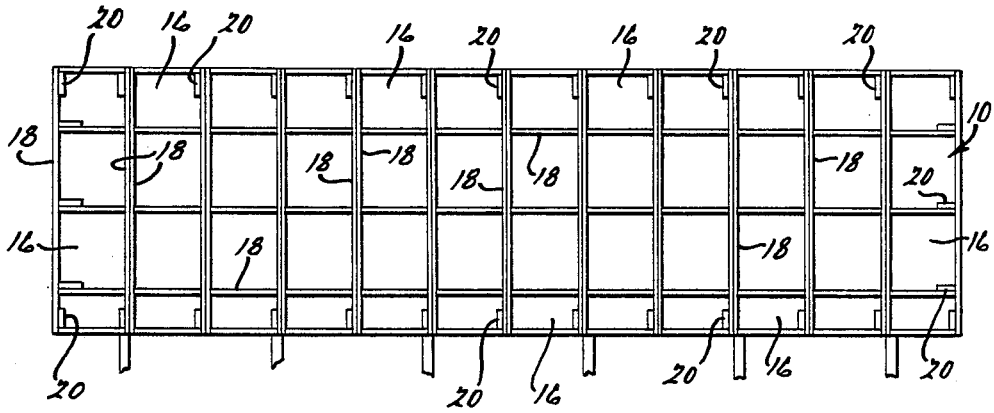
FIG. 2 is a somewhat diagrammatic elevational view of the rear face of the billboard of FIG. 1, generally illustrating the installation of a number of anchoring apparatuses according to the present invention for anchoring and selectively tensioning or relaxing a sheet material display on the billboard.

FIGS. 1 and 2 depict a large billboard structure 10, which can be mounted on the roof of a building 12 or supported from the ground in many typical installations. In a common construction of such a billboard structure 10, a relatively flexible sheet material display 14, bearing an advertising or public service message, is disposed on a front face of the billboard structure 10, with edge portions of the sheet material display extending around the edge of the billboard structure and along a portion of the rear face of the billboard structure 10.

Figure 3:
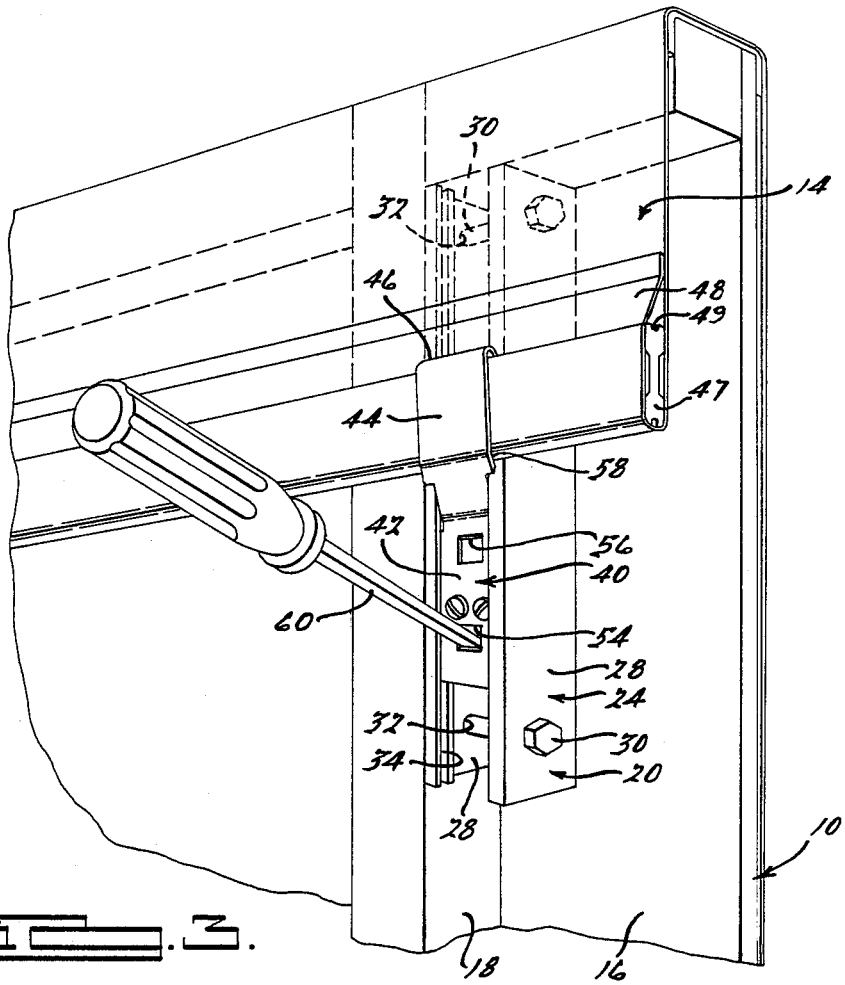
FIG. 3 is an enlarged, perspective detail view of one of the anchoring apparatuses according to the present invention installed on a typical billboard structure.
Figure 6:
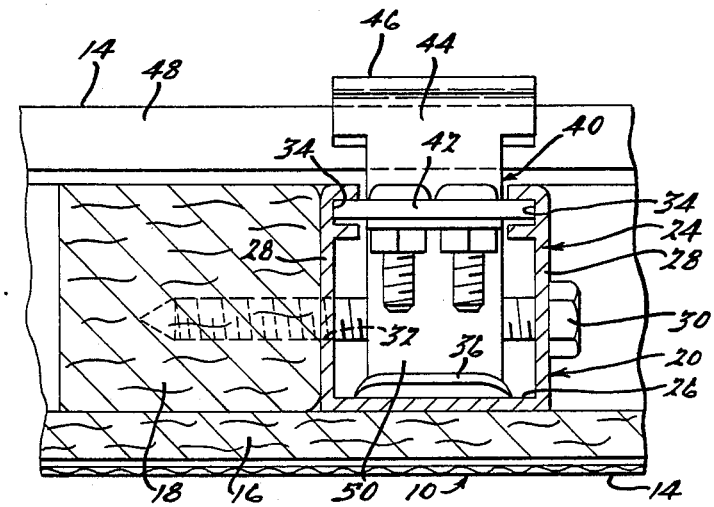
FIG. 6 is a cross-sectional view taken generally along line 6—6 of FIG. 4.
Figure 4:
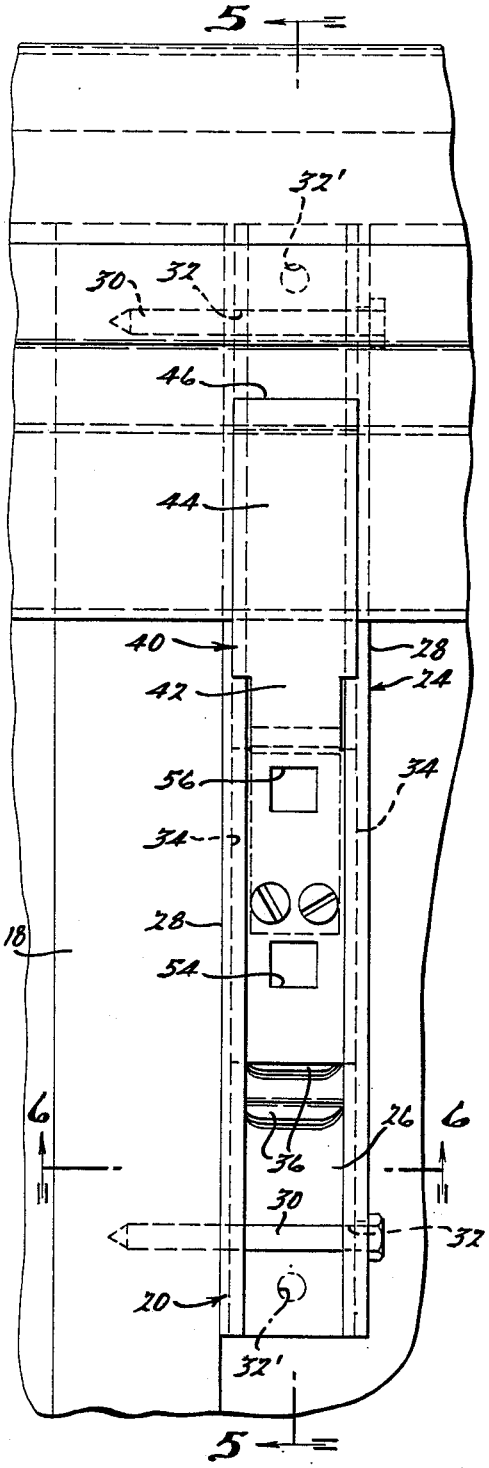
FIG. 4 is an elevational view of the anchoring apparatus of FIG. 3.

As illustrated in FIGS. 2 and 3, the billboard structure 10 typically includes a number of panel portions 16, with their associated panel frames 18. In the common fourteen-foot by forty-eight foot size billboard mentioned above, such a construction would result in twelve four-foot by fourteen-foot panel portions being secured together by fastening or securing means, such as lag screws, tie rods, or other securing methods known to those skilled in the art. As shown diagrammatically in FIG. 2, a number of anchoring apparatuses 20, according to the present invention, are secured to the panel frames 18 of the panel portion 16 and grippingly engage the sheet material display 14, as is shown in more detail in FIG. 3.

Each of the preferred anchoring apparatus 20 for the exemplary billboard application illustrated in the drawings includes a base member 24, which has a generally U-shaped lateral cross-section, including a base plate portion 26 and a pair of laterally spaced-apart leg portions 28 protruding rearwardly or outwardly from the base plate portion 26, as shown in FIGS. 3 through 6. One or more fasteners 30 extend through openings 32 in the leg portions 28 in order to fixedly secure the base member 24 to the panel frames 18 of the panel portions 16. Optionally, however, if necessary or desired in a particular application, openings 32' can be provided in the base plate portion 26 in addition to, or in lieu of, the openings 32 extending through the leg portions 28.

Each of the leg portions 28 preferably includes a slot 34 extending longitudinally therethrough, with the slots 34 preferably facing generally toward one another and disposed generally at outer edges of the leg portions 28. A plurality of ratchet teeth 36 are preferably included in the base plate portion 26, although in certain applications of the present invention, such ratchet teeth 36 could alternately be provided at positions other than on the base plate portion 26, as will become apparent to one skilled in the art.

A clip member 40 includes a clip plate portion 42, whose lateral edges are preferably slidably received within the slots 34 in the leg portions 28 for selective slidable longitudinal movement relative to the base member 24. The clip member 40 also includes an attachment portion 44, which can be formed integrally with the clip plate portion 42, as illustrated in the drawings, or which can alternately be a separate piece secured to the clip plate portion by fasteners, such as screws, rivets, or other means suitable for the given application. The attachment portion 44 preferably includes a generally hook-shaped end 46, which is adapted to grippingly and anchoringly engage a preferred anchor member or bar 47 secured to the sheet material display 14, such as the anchoring member 47 shown in the drawings, which is received within a hem portion 48. The preferred anchoring member 47 includes a groove 49 formed in one or more of its edges for receiving the hook-shaped end 46 of the attachment portion 44 in a generally interlocking, but releasable relationship, shown in FIGS. 3 and 5.

The clip member 40, which is preferably composed of spring steel, also includes a pawl portion 50, which likewise may be integrally formed therewith, or attached thereto as shown in the drawings, with the pawl portion 50 preferably being resiliently biased into engagement with the ratchet teeth 36, such that when the pawl portion 50 is in such engagement with any one of the ratchet teeth 36, the clip member 40, and thus the sheet material display 14 are substantially prevented from longitudinal movement in a direction toward the edge of the billboard structure 10, as shown in FIG. 3. In order to securely retain the sheet material display 14 in its desired position on the billboard structure 10, with a desired amount of tension in order to substantially eliminate or minimize wrinkles in the sheet material display, the clip member 40 is urged in a tensioning direction, generally away from the edge of the billboard structure 10 shown in FIG. 3, with the pawl portion 50 resiliently engaging one of the ratchet teeth 36.

Figure 5:
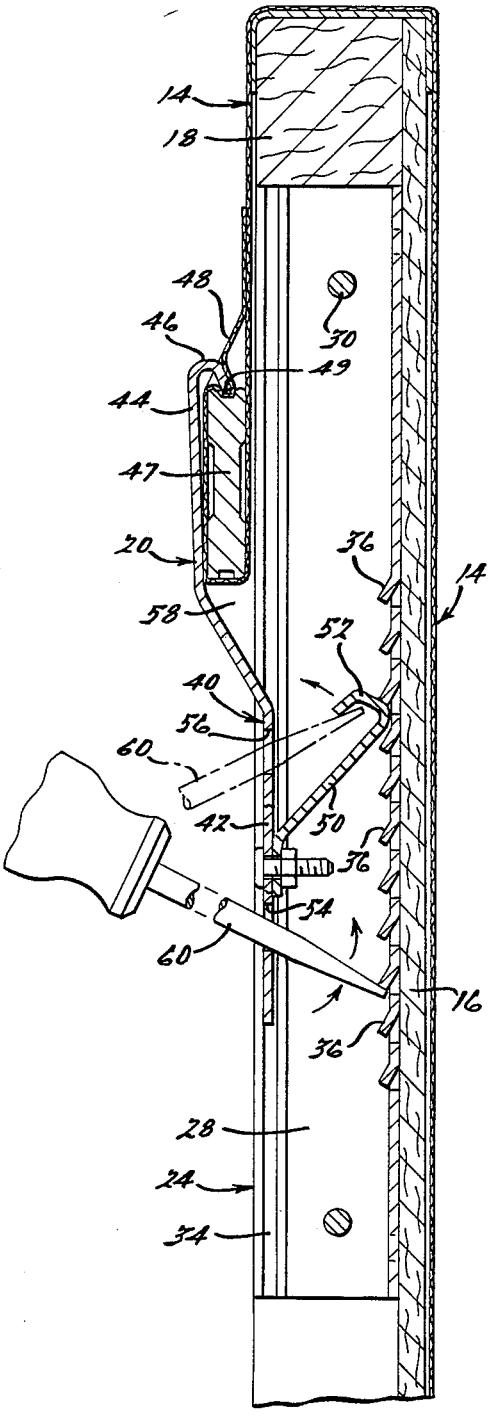
FIG. 5 is a cross-sectional view taken generally along line 5—5 of FIG. 4.

In order to increase the tension on the sheet material display 14, a tensioning opening 54 is provided in the clip plate portion 42 for allowing the insertion of a screwdriver or other lever member 60 therethrough into engagement with one of the ratchet teeth 36. After which, the lever member 60 can be manipulated in a generally prying or pivoting manner in order to forcibly urge the clip plate portion, and thus the edge of the sheet material display 14, in a tensioning direction away from the edge of the billboard structure 10, as shown in FIGS. 3 and 5. Because the preferred anchoring apparatus 20 is secured to, and thus permanently associated with, each of the panel portions 16 in the exemplary application shown in the drawings, such anchoring and selective tensioning of the sheet material display 14 is accomplished with relative ease and convenience, using only a common tool, such as a screwdriver, as a lever member 60. In addition, no separate straps or ratchet wheels need be provided at a billboard site or carried up onto a billboard structure.

When it is desired to remove or replace a particular sheet material display 14, in order to eliminate or change the message displayed on the billboard structure 10, a screwdriver or lever member 60 can then be inserted through a release or relaxation opening 56 in the clip plate portion 42, into engagement with a hook or discontinuity 52 in the pawl portion 50 in order to allow the resiliently-biased pawl portion 50 to be pried or pivoted out of engagement with the ratchet teeth 36. This allows the clip plate portion, and thus the attachment portion 44, the anchoring member 47, and the edge of the sheet material display 14, to be moved in a second longitudinal direction, generally toward the edge of the billboard structure 10, as shown in the detailed perspective view of FIG. 3. Such a maneuver releases the tension on the sheet material display 14, thereby allowing the anchoring member 47 to then be moved slightly in a downward direction (as viewed in FIG. 3) to disengage the hook-shaped end 46 of the attachment portion 44 from the groove 49 in the anchoring member 47. The anchoring member 47 can be rotated slightly out of the space 58 between the offset and preferably resilient attachment portion 44 and the base member 24, thereby releasing the edge of the sheet material display 14 from the anchoring apparatus 20, and consequently allowing removal or replacement of the sheet material display 14.

After the display sheet 14 has been removed, the anchoring apparatuses 20 remain secured to the panel frame members 18 and can be left with their clip members 40 in a relaxed or "loosened" positions generally aligned with one another to allow for ease of insertion of, and engagement with, the anchoring member 47 on the display sheet 14 of a new display. This aids greatly in the erection, anchoring and tensioning of the replacement display.

The foregoing discussion discloses and describes exemplary embodiments of the present invention. One skilled in the art will readily recognize from such discussion, and from the accompanying drawings and claims, that various changes, modification and variations may be made therein without departing from the spirit and scope of the invention as defined in the following claims.

I claim:

1. An apparatus for anchoring and selectively tensioning and relaxing a sheet material on a planar surface structure, said apparatus comprising:

an elongated base member having a generally U-shaped lateral cross-section, said base member including a base plate portion and a pair of laterally spaced-apart leg portions protruding from said base plate portion, each of said leg portions having a slot formed therein, said slots facing generally toward one another, said base member further having a number of ratchet teeth serially spaced longitudinally therealong;

means for fixedly securing said elongated base member to the planar surface structure;

a clip member having a clip plate portion received within said slots for selective slidable longitudinal movement along said base member, an attachment portion for releasably engaging a portion of the sheet material, and a pawl portion protruding from said clip plate portion and resiliently biased toward releasable engagement with any one of said ratchet teeth on said base member in order to substantially prevent longitudinal movement of said clip member relative to said base member in a first longitudinal direction when said pawl portion engages one of said ratchet teeth;

first means in said clip plate portion to allow a lever member to be inserted for selectively moving said clip member in a second, opposite longitudinal direction relative to said base member in order to serially advance said pawl portion from engagement with one of said ratchet teeth to engagement with an adjacent ratchet tooth and to tension the sheet material; and second means in said clip plate portion to allow a lever member to be inserted for selectively disengaging said pawl portion from said ratchet teeth in order to allow movement of said clip member relative to said base member in said first longitudinal direction and to relax said sheet material.

2. An apparatus according to claim 1, wherein said attachment portion of said clip member includes a generally hook-shaped end adapted for releasable engagement with the sheet material.

3. An apparatus according to claim 2, wherein the sheet material includes an anchor member secured thereto, said anchor member having a groove formed therein for releasably receiving said hook-shaped end in a interlocking engagement with said anchor member.

4. An apparatus according to claim 3, wherein said attachment portion of said clip member further includes an offset portion offset away from said base member and disposed adjacent said hook-shaped end, said anchor member on the sheet material being disposed between said offset portion and said base member when said hook-shaped end is received within said groove in said anchor member.

5. An apparatus according to claim 4, wherein said offset portion of said clip member is resiliently biased into said offset relationship with said base member.

6. An apparatus according to claim 1, wherein said first means includes an opening formed in said clip plate portion and is positioned to allow a lever member to be selectively inserted therethrough into engagement with said ratchet teeth in order to forcibly urge said clip member in said second longitudinal direction relative to said base member.

7. An apparatus according to claim 1, wherein there is a discontinuity on said pawl portion of said clip member, and said second means includes an opening formed in said clip plate portion and is positioned to allow a lever member to be selectively inserted through said opening into engagement with said discontinuity on said pawl portion in order to forcibly disengage said pawl portion from said ratchet teeth and allow said clip member to be moved relative to said base member in said first longitudinal direction.

8. An apparatus according to claim 7, wherein said first means includes a second opening formed in said clip plate portion and is positioned to allow a lever member to be selectively inserted therethrough into engagement with said ratchet teeth in order to forcibly urge said clip member in said second longitudinal direction relative to said base member.

9. An apparatus for anchoring and selectively tensioning and relaxing a sheet material display on a billboard structure, the sheet material display being disposed on a front face of the billboard structure with at least one end portion extending over an edge of the billboard and along a portion of a rear face of the billboard structure, said apparatus comprising:

an elongated base member having a generally U-shaped lateral cross-section, said base member including a base plate portion and a pair of laterally spaced-apart leg portions protruding from said base plate portion, each of said leg portions having a slot formed therein, said slots facing generally toward one another, said base member further having a number of ratchet teeth serially spaced longitudinally therealong;

means for fixedly securing said elongated base member to the rear face of the billboard structure;

a clip member having a clip plate portion received within said slots for selective slidable longitudinal movement along said base member, an attachment portion having an attachment end adapted for releasably engaging a portion of the sheet material display, and a pawl portion having a discontinuity thereon and protruding from said clip plate portion and resiliently biased toward releasable engagement with any one of said ratchet teeth on said base member in order to substantially prevent longitudinal movement of said clip member relative to said base member in a first longitudinal direction generally toward the edge of the billboard structure when said pawl portion engages one of said ratchet teeth, said clip plate portion having a first opening formed therethrough for allowing a lever member to be selectively inserted therethrough into engagement with said ratchet teeth in order to forcibly urge said clip member in a second, opposite longitudinal direction relative to said base member in order to serially advance said pawl portion from engagement with one of said ratchet teeth to engagement with an adjacent ratchet tooth and to tension the sheet material display in said second longitudinal direction, said clip plate portion also having a second opening formed therethrough for allowing the lever member to be selectively inserted therethrough into engagement with said discontinuity on said pawl portion in order to forcibly disengage said pawl portion from said ratchet teeth and to allow movement of said clip member relative to said base member in said first longitudinal direction to relax said sheet material display.

10. An apparatus according to claim 9, wherein said attachment end of said attachment portion is generally hook-shaped, the sheet material display including an anchor member secured to the portion of the sheet material display extending along a portion of the rear face of the billboard structure, the anchor member having a groove formed therein for releasably receiving said hook-shaped attachment end in an interlocking engagement with the anchor member.

11. An apparatus according to claim 10, wherein said attachment portion of said clip member further includes an offset portion offset away from said base member and disposed adjacent said hook-shaped end, said anchor member on the sheet material display being disposed between said offset portion and said base member when said hook-shaped end is received within said groove in said anchor member.

12. An apparatus according to claim 11, wherein said offset portion of said clip member is resiliently biased into said offset relationship with said base member.

* * * * *